US007320440B2

(12) United States Patent
Prociw et al.

(10) Patent No.: US 7,320,440 B2
(45) Date of Patent: Jan. 22, 2008

(54) LOW COST PRESSURE ATOMIZER

(75) Inventors: Lev Alexander Prociw, Elmira (CA); Joseph Horace Brand, Mississauga (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 335 days.

(21) Appl. No.: 11/050,685

(22) Filed: Feb. 7, 2005

(65) Prior Publication Data

US 2006/0175428 A1 Aug. 10, 2006

(51) Int. Cl.
*B05B 1/34* (2006.01)
*B05B 7/10* (2006.01)

(52) U.S. Cl. ..... 239/491; 239/468; 239/451; 239/402; 239/405; 239/492

(58) Field of Classification Search ..... 239/402, 239/405, 428.5, 463, 466, 468, 490, 492, 239/493; 60/39.74, 39.01, 776
See application file for complete search history.

(56) References Cited

U.S. PATENT DOCUMENTS 2,904,263 A * 9/1959 Tate et al. ..... 239/494
3,657,885 A 4/1972 Bader
3,680,793 A * 8/1972 Tate et al. ..... 239/468
3,799,449 A 3/1974 Gardner
3,913,318 A 10/1975 Fox et al.
4,076,174 A * 2/1978 Volgel et al. ..... 239/492
4,087,050 A * 5/1978 Tsuji et al. ..... 239/490
4,188,782 A 2/1980 Smith et al.
4,242,863 A 1/1981 Bailey
RE30,925 E 5/1982 Smith et al.
4,360,156 A * 11/1982 Soth et al. ..... 239/11
4,613,079 A * 9/1986 Mains ..... 239/462
4,946,105 A 8/1990 Pane, Jr. et al.
4,986,068 A 1/1991 Lee et al.
5,097,657 A 3/1992 Shekleton et al.
5,152,463 A * 10/1992 Mao et al. ..... 239/402
5,224,333 A 7/1993 Bretz et al.
6,095,436 A 8/2000 Seegers et al.
6,193,172 B1 * 2/2001 Soule et al. ..... 239/468
6,241,165 B1 * 6/2001 Bickart et al. ..... 239/491
6,371,389 B1 * 4/2002 Bickart et al. ..... 239/491
6,394,366 B1 * 5/2002 Adams ..... 239/463
2001/0010341 A1 8/2001 Koizumi et al.

OTHER PUBLICATIONS

International Search Report dated May 23, 2006 for corresponding PCT International Application No. PCT/CA2006/000151.

* cited by examiner

*Primary Examiner*—Kevin Shaver
*Assistant Examiner*—James S. Hogan
(74) *Attorney, Agent, or Firm*—Ogilvy Renault LLP

(57) ABSTRACT

A spray device, useful for example as a fuel nozzle for gas turbine engines, comprises a body having a bore and a cap member having an orifice, the body and cap member in combination defining a chamber. Fluid passages introduce pressurized liquid into the chamber and direct a flow into the bore, thereby causing a spinning flow to be forced out through the orifice.

20 Claims, 4 Drawing Sheets

LOW COST PRESSURE ATOMIZER

FIELD OF THE INVENTION

The present invention relates to spray devices and in particular to fuel spray devices for gas turbine engines, such as fuel nozzles and igniters.

BACKGROUND OF THE INVENTION

A wide variety of fuel injection devices, systems and methods have been employed in the past for the atomization of fuel to support ignition and combustion for driving prime movers such as gas turbines. These various devices, systems and methods each enjoy certain advantages, but they also suffer certain disadvantages. One common disadvantage is the difficulty of manufacturing those devices due to the relatively complicated configurations thereof, especially when conical surfaces are employed for directing fuel or air flows, and the resultant relatively high cost of manufacturing same. Simplifying the configuration of the pressure atomizing fuel tips and thereby reducing the manufacturing expenses of the fuel injector assemblies of the gas turbine engine is desirable.

Therefore, there is a need for low cost pressure atomizing fuel injectors.

SUMMARY OF THE INVENTION

One object of the present invention is to provide a spray device having a simple configuration which is suitable for a fuel injector for gas turbine engines.

In accordance with one aspect of the present invention, there is a fuel spray device provided for gas turbine engines which comprises a body having a generally cylindrical central bore having a closed end and an open end thereof; a cap member mounted to the body and closing the open end of the bore to provide a swirl chamber; fluid passages defined between the body and the cap member and positioned to introduce pressurized fuel generally tangentially into the swirl chamber at a location adjacent the cap member; and an orifice extending through the cap member and communicating with the swirl chamber, the orifice being positioned generally coaxially with the swirl chamber to receive an exit fuel flow from the chamber.

In accordance with another aspect of the present invention, there is a fuel spray device provided for gas turbine engines which comprises a substantially cylindrical body and a cap member. The body has an annular shoulder extending radially and outwardly and being axially spaced apart from a front end thereof. A substantially cylindrical bore is coaxially defined in the front end of the body. The cap member defines a substantially cylindrical cavity extending axially from a rear open end to a closed front end thereof. The closed front end further defines an orifice axially extending therethrough and being positioned coaxially with the substantially cylindrical cavity. The cavity accommodates a front section and the annular shoulder of the body to thereby form an annular chamber between the shoulder and the closed front end. A first fluid passage is defined for introducing fuel from a pressure fuel source into the annular chamber and a second fluid passage is defined between the bore and the annular chamber for directing a fuel flow from the annular chamber tangentially into the bore, thereby causing a spinning fuel flow in the bore which is substantially redirected out through the orifice.

In accordance with a further aspect of the present invention, there is a fuel injector assembly provided for a gas turbine engine which comprises a body having a cylindrical bore and a cap member having a central orifice extending therethrough, the body and cap member in combination defining an chamber positioned generally coaxially with the bore, the assembly including fluid passages defined between the body and the cap member for swirling introducing of fuel into the bore at a end of the bore adjacent the cap, thereby causing a spinning fuel flow in the bore to be directed initially away from the cap member and then be redirected by a bottom of the bore centrally out of the chamber through the central orifice.

The present invention advantageously provides a simple configuration for spray devices which can be used as pressure atomizing fuel tips employed in a fuel injector assembly for gas turbine engines. This configuration does not need to employ any conical surfaces, making it easy to manufacture and reducing manufacturing costs thereof. This and other advantages will be better understood with reference to preferred embodiments of the present invention described hereinafter.

BRIEF DESCRIPTION OF THE DRAWINGS

Reference will now be made to the accompanying drawings in which.

DETAILED DESCRIPTION OF THE PREFERRED EMBODIMENTS

Figure 1:
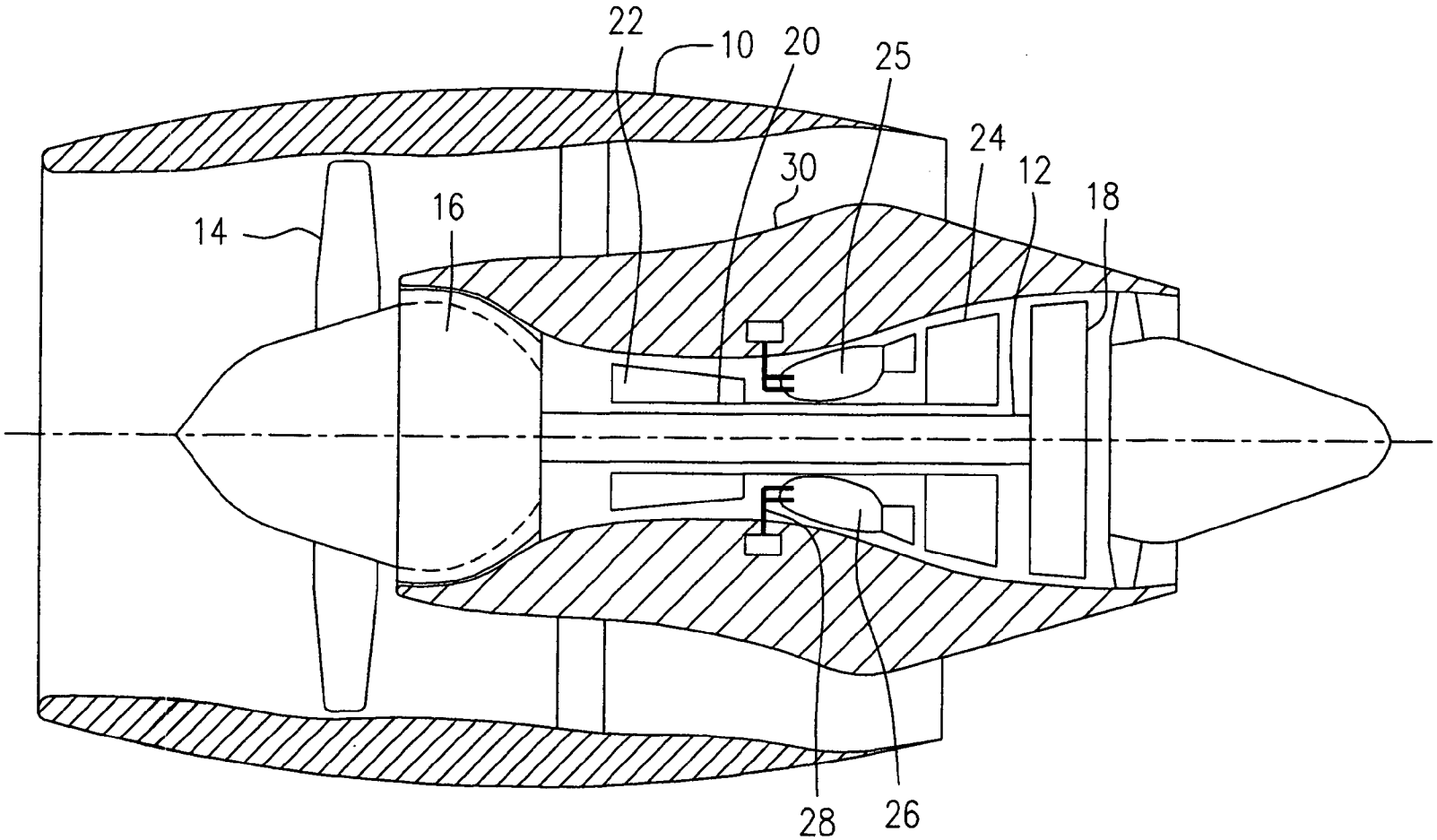
FIG. 1 is a schematic cross-sectional view of an exemplary turbofan gas turbine engine, showing an application of the present invention.

A typical application of the present invention for a turbofan engine illustrated schematically in FIG. 1, incorporates an embodiment of the present invention presented as an example of the application of the present invention, and includes a housing or nacelle 10, a low pressure spool assembly seen generally at 12 which includes a fan 14, low pressure compressor 16 and low pressure turbine 18, a high pressure spool assembly seen generally at 20 which includes a high pressure compressor 22 and a high pressure turbine 24. There is provided a burner seen generally at 25 which includes an annular combustor 26 and a plurality of fuel injectors 28 according to the present invention for mixing liquid fuel with air an injecting the mixed fuel/air flow into the annular combustor 26 for combustion. Application of the invention is not restricted to turbofans or gas turbine engines or fuel injectors, however this environment is convenient for describing the present invention.

The combustor 26 is disposed between the high pressure compressor 22 and the high pressure turbine 24 and is supported within a core casing 30 of the turbofan engine. The plurality of fuel injectors 28 are disposed circumferentially spaced apart one from another and mounted with the core casing 30. The fuel injectors 28 according to the present invention include a plurality of pressure atomizing fuel injectors (to be described below) connected in fluid communication with a fuel source (not shown).

Figure 2:
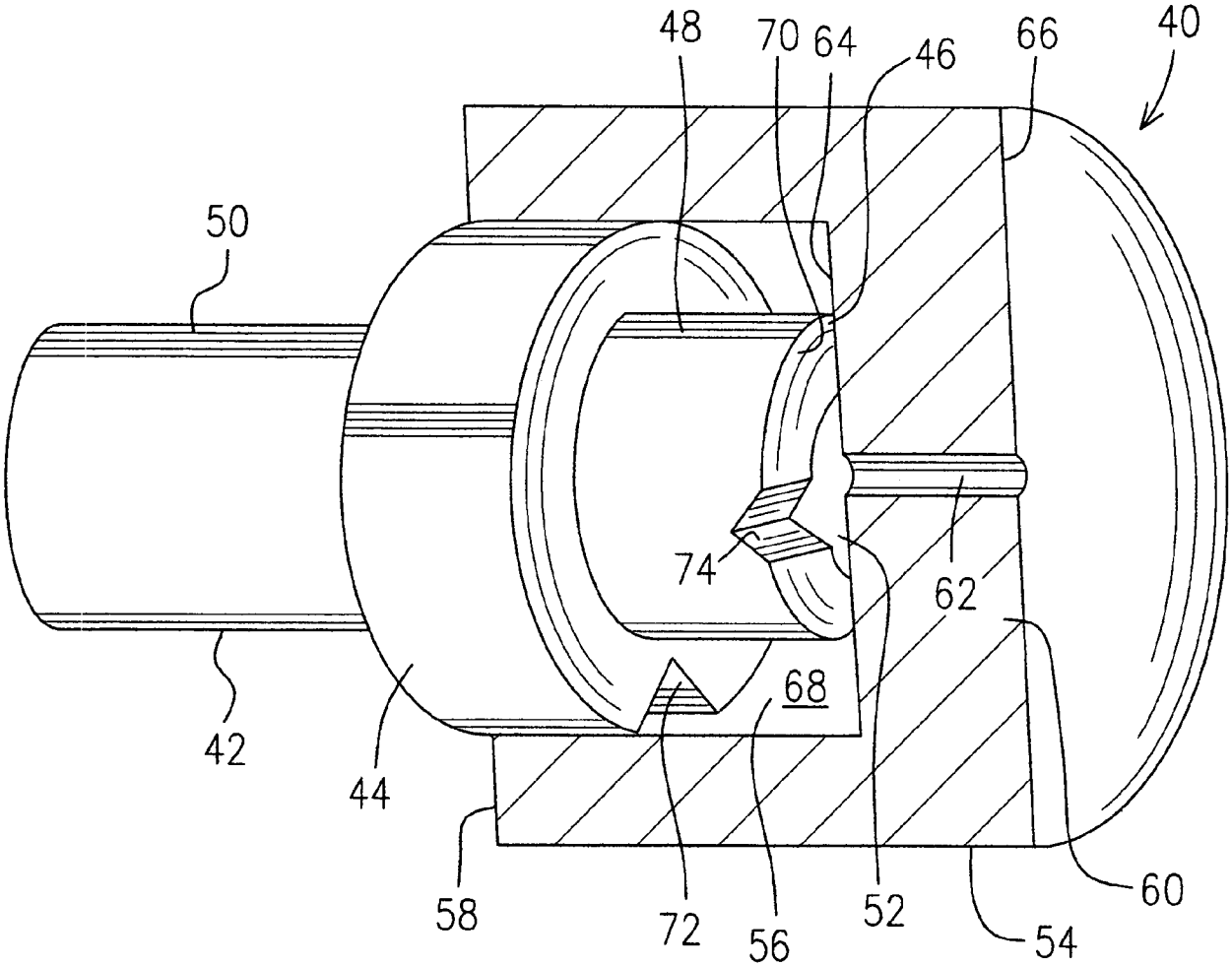
FIG. 2 is an isometric view of a pressure atomizing fuel injector according to one embodiment of the present invention, with a front half of a cap member thereof being cut away to show the internal details thereof.
Figure 3:
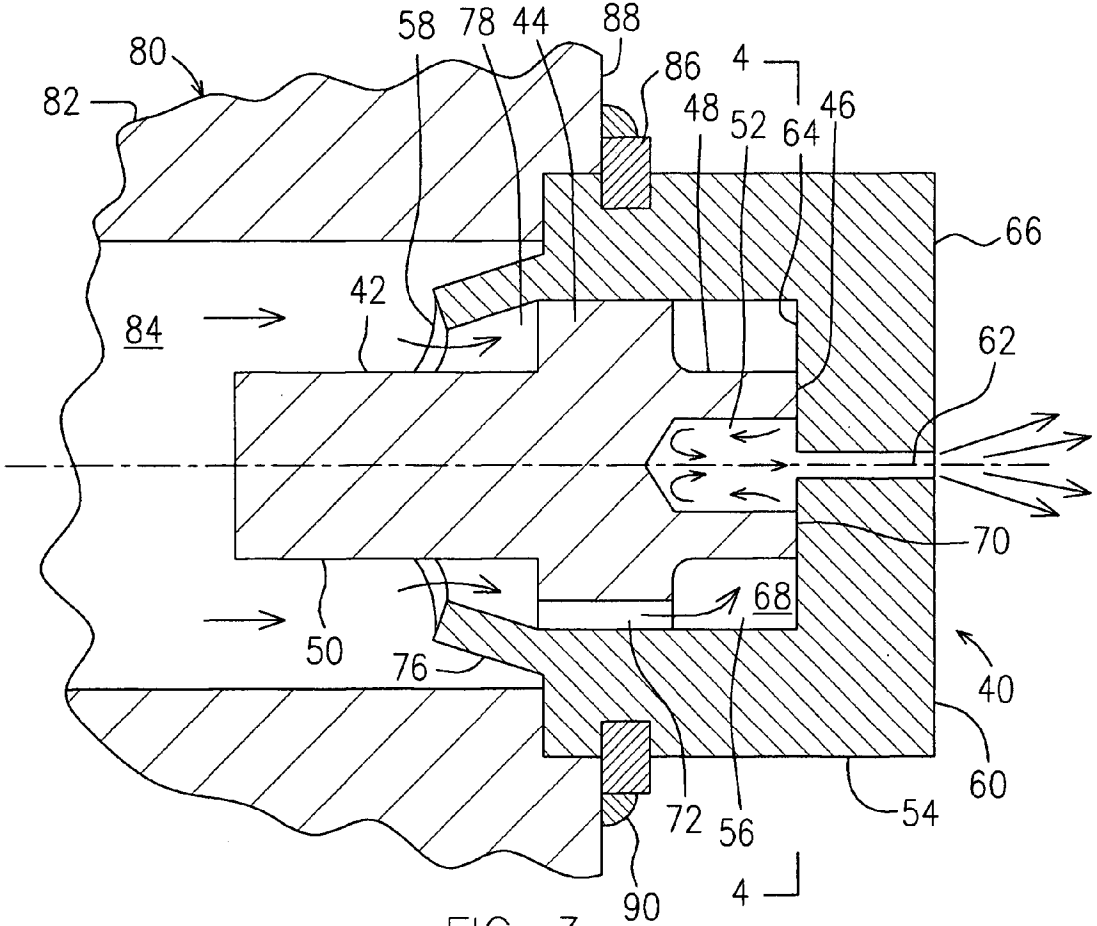
FIG. 3 a cross-sectional view of a fuel injector assembly according to another embodiment of the present invention.
Figure 4:
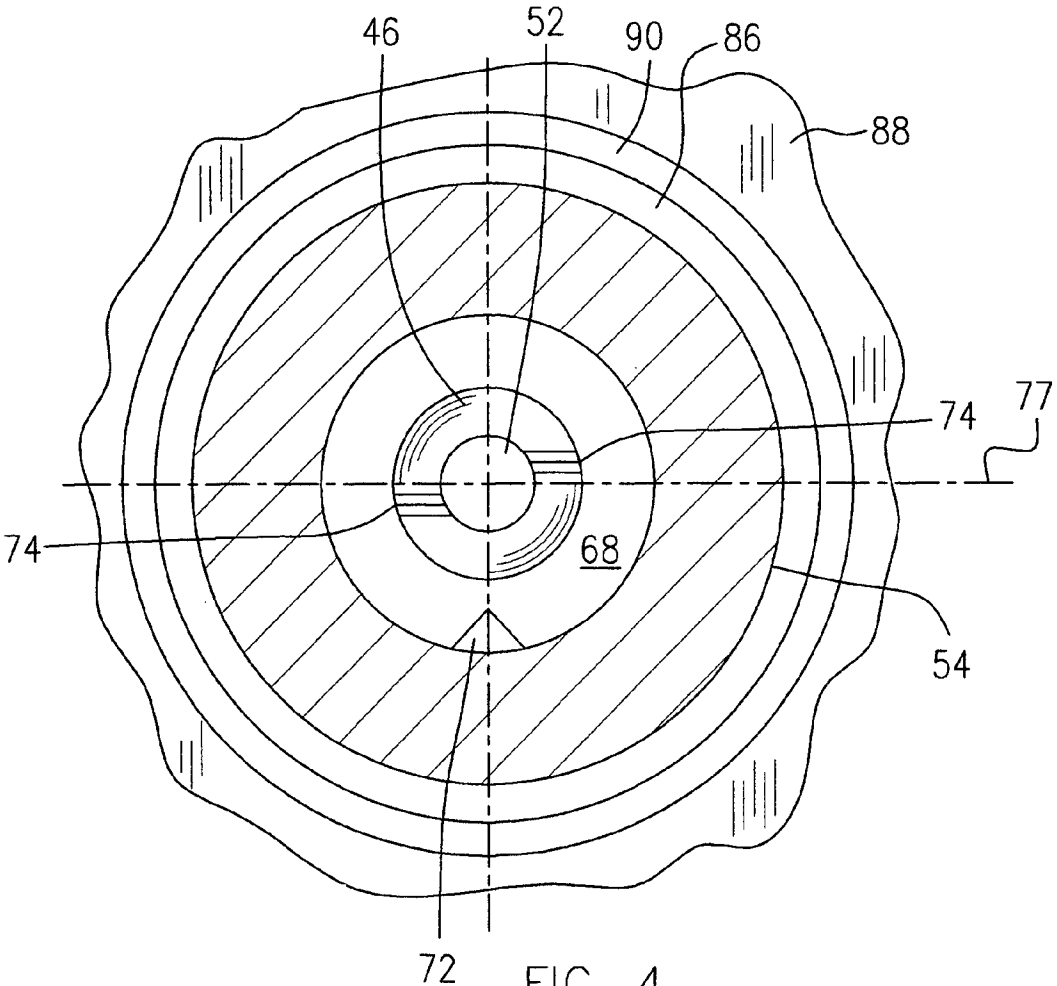
FIG. 4 is a cross-sectional view of the fuel injector assembly of FIG. 3, taken along line 4-4 thereof.

It should be noted that similar components of the different embodiments shown in FIGS. 2-4 are indicated by similar numerals for convenience of description of the present invention. Only those components different in one embodiment from the other will be separately described with reference to additional numerals.

Referring to FIGS. 2 and 4, a fuel spray device, or more specifically a simplex pressure atomizing fuel injector according to one embodiment of the present invention and generally indicated by numeral 40 includes a substantially cylindrical body 42. The body 42 includes an annular shoulder 44 extending radially and outwardly therefrom at a middle portion thereof and being axially spaced apart from a front end 46 of the body 42. Thus, the body 42 is divided into a front section 48 and a rear section 50 flanking the shoulder 44. A preferably substantially cylindrical swirl cavity or bore 52 having an open end and a closed end thereof, is coaxially defined in the front end 46 of the body 42.

The pressure atomizing fuel injector 40 further includes a cap member 54 defining a cavity 56 extending axially from a rear open end 58 to a closed front end 60 thereof. The closed front end 60 further defines an orifice 62 axially extending through the closed front end 60 between preferably substantially flat inner and outer radial surfaces 64 and 66. The orifice 62 is preferably positioned coaxially with the cavity 56.

The cavity 56 of the cap member 54 accommodates the front section 48 and the shoulder 44 of the body 42 to thereby forms an plenum or chamber 68 between the shoulder 44 of the body 42 and the closed front end 60 of the cap member 54. The chamber 68 is substantially isolated from bore 52 because a surface 70 of the front end 46 of the body 42 abuts surface 64 of cap member 54.

A first fluid passage 72, preferably a V-shaped groove 72 in this embodiment, is provided in the body 42 and extends axially through the shoulder 44. First passage 72 provides an access for fluid to enter cavity 68, and is preferably sized and configured to cause as small a pressure drop as possible. Quiescent conditions are preferred in cavity 68, as will be explained further below.

A second set of fluid passages 74, preferably two V-shaped grooves 74 in this embodiment (only one is shown in FIG. 2), is defined in the front end 46 of the body 42. The passages 74 are configured to introduce liquid into the bore 52 in a swirling manner, in this embodiment that is achieved by offsetting the passage from a diametrical line 77 (see FIG. 4) of the bore 52. Passage 74 extend from the chamber 68 to the bore 52 for fluid communication therebetween.

In operation, the passage 72 is in fluid communication with a pressure fuel source of a gas turbine engine for introducing the pressurized fuel into the chamber 68. The fuel under pressure in the chamber 68 is preferably relatively quiescent before it enters the bore 52 through the passages 74. The fuel enters the bore 52 in a generally tangential direction, thereby causing the fuel to spin within the bore 52. The fuel flow is spinningly introduced at the open end of bore 52, and thus reverses direction relative to the general direction of fuel flow in the nozzle, and flows rearwardly towards the closed end of the bore 52, at which point the fuel flow reverses again in a vortexs like manner, and then travels down the centre of bore and exits bore through the orifice 62. The passages 74 are preferably sized to meter the fuel flow which is ultimately discharged through the orifice 62 (see the arrows of FIG. 3).

It should be noted that the present invention provides a pressure atomizing fuel injector usually known as a "simplex pressure atomizer", and as such does not require independent air jets to atomize the flow and produce spray. The present device can produce a very fine, conical shaped spray. The cone of the fuel spray is intended to be narrow, which is difficult to achieve with most conventional fuel injectors. The offset distance and angle between the passages 74 and the length and diameter of the orifice 62, and the size of bore 52 in combination, control the fuel spray cone angle. The depth of the passages 74 and the diameter of the orifice 62 in combination control the fuel pressure drop. While passages 74 may be quite small (e.g. perhaps as small as 0.010"), passage(s) 72 is much larger, as noted above.

In the embodiment of FIG. 2, the body 42 may be secured to cap member 54 by any suitable means, such as threads (not shown), or by welding or brazing processes. The embodiment of the present invention shown in FIG. 2, as a fuel spray device for gas turbine engines, can be used in any types of combustors, either as a single device or as a part of a fuel injector assembly.

The embodiment of the present invention shown in FIG. 3 illustrates another application of the present invention. The cap member 54 includes a rear end portion 76 thereof extending rearwardly behind the shoulder 44 and being deformed, for example crimped, radially and inwardly to secure same to the body 42 affixed in the cavity 56 of the cap member 54. The rear end portion 76 preferably has an outer diameter smaller than the diameter of the remaining portion of the cap member 54, thereby resulting in the thinner rear end portion 76 which can be more conveniently crimped. An annular axial passage 78 is formed between the crimped rear end portion 76 and the rear section 50 of the body 42, which is in fluid communication with the chamber 68 through the axial passage 72.

The pressure atomizing fuel injector 40 according to the embodiment shown in FIG. 3, is part of a fuel injector assembly 80 which includes a base structure 82 defining a plurality of cavities 84 (only one shown) in fluid communication with a pressure fuel source.

The pressure atomizing fuel injector 40 is affixed at a rear portion thereof within one of the cavities 84 of the base structure 82, and is secured by any known mechanisms. For example, a split metal seal ring 86 is received within an annular groove defined in the outer periphery of the cap member 54. The split metal seal ring 86 radially protrudes from the cap member 54 and abuts at a rear side thereof a flat surface 88 of the base structure 82. Welding beads 90 are applied around the split metal seal ring 86 and between the split metal ring seal 86 and the flat surface 88. Therefore, the pressure atomizing fuel injector 40 is sealingly affixed to the cavity 84 of the base structure 82 such that the fuel within the cavity 84 under pressure flows into the chamber 68 through the passage 78 and the passage 72 of the fuel injector 40. The fuel in the chamber 68 under pressure will further enter the bore 52 in the spinning pattern and after being reversed twice (as described above) exits through the orifice 62. Orifice 62 is thus preferably positioned on cap 54 to accept the flow from the centre of this vortex flow.

In contrast to various configurations of conventional fuel injectors, the advantage of the pressure atomizing fuel injector of the present invention lies in the simplicity of construction of the device which requires simple machining processes. For example, the device of FIG. 2 can be produced using substantially only an end milling process to create V-shaped grooves 74 and a drilling process to create the bore 52 and orifice 62. There is no complicated conical configuration required, and thus manufacturing is simplified, and thus cheaper. The design permits turning operations to be maximized, which tend to offer a higher accuracy-per-dollar ratio than other manufacturing operations. Even common features such as threads, braze joints and welds can be eliminated. The crimping attachment of the body to the cap member also makes the assembly process more efficient for that embodiment. These features contribute to a reduction in manufacturing costs of the device.

Although a turbofan gas turbine engine was taken as an example of the application of the present invention, it should be noted that the present invention is applicable to gas turbines and engines and spraying applications of almost any type. The passages 72 and 74 need not be V-shaped, and any suitable shape and/or method of making may be used. The passage 72 is not required, but plenum 68 preferably provides a relatively quiescent flow to passages 74, to maximize the amount of control the designer has over the injection conditions at passage 74. Though in theory one passage 74 may be provided, two or more are preferred for gas turbine fuel nozzle applications, to provide the desired atomization effects. The bore 52 need not be cylindrical, but preferably supports a swirl or vortex flow therein. Cylindrical is preferred mainly because is provides a low-cost option for manufacturing. Although the passages 74 are preferably defined in body 42, they may also or instead be defined in cap 54. Modifications and improvements to the above-described embodiments of the present invention may become apparent to those skilled in the art. The foregoing description is intended to be exemplary rather then limiting. The scope of the present invention is therefore intended to be limited solely by the scope of the appended claims.

We claim:

1. A fuel spray device comprising a body having a generally cylindrical central bore having a closed end and an open end thereof; a cap member mounted to the body and closing the open end of the bore to provide a swirl chamber within the body; fluid passages defined between the body and the cap member and positioned to introduce pressurized fuel only at the open end of the bore generally tangentially into the swirl chamber to axially travel the chamber; and an orifice extending through the cap member and communicating with the swirl chamber, the orifice being positioned generally coaxially with the swirl chamber to receive an exit fuel flow from the chamber.

2. The fuel spray device as claimed in claim 1, wherein the bore is cylindrical.

3. The fuel spray device as claimed in claim 1, wherein the cap member has a substantially flat surface which closes the open end of the bore.

4. The fuel spray device as claimed in claim 1 further comprising a plenum communicating with an upstream side of the passages.

5. The fuel spray device as claimed in claim 1 wherein the passages are disposed circumferentially offset from a centreline of the bore.

6. The fuel spray device as claimed in claim 1 wherein the passages comprise a groove in an end of the body defining the open end of the bore.

7. The fuel spray device as claimed in claim 6 wherein the grooves have V-shaped cross section thereof.

8. The fuel spray device as claimed in claim 1 wherein the bore extends away from the orifice, and wherein the passages are positioned and the bore configured such that fuel entering the swirl chamber swirls away from the orifice, and is redirected by the closed end of the bore to exit the chamber centrally through the orifice.

9. A fuel spray device for gas turbine engines, comprising:

a substantially cylindrical body having an annular shoulder extending radially and outwardly and being axially spaced apart from a front end thereof, a substantially cylindrical bore with an open end and a closed end thereof being coaxially defined in the front end thereof; and a cap member defining a substantially cylindrical cavity extending axially from a rear open end to a closed front end thereof, the closed front end further defining an orifice axially extending therethrough and being positioned coaxially with the substantially cylindrical cavity, the cavity accommodating a front section and the annular shoulder of the body to thereby form an annular chamber between the shoulder and the closed front end, a first fluid passage being defined for introducing fuel from a pressure fuel source into the annular chamber, a second fluid passage being defined between the body and the cap member for directing a fuel flow from the annular chamber tangentially into the bore only at the open end of the bore, thereby forming the bore into a swirl chamber substantially upstream of the second fluid passage, in the swirl chamber a spinning fuel flow being subsequently redirected out through the orifice.

10. The fuel spray device as claimed in claim 9 wherein the first passage comprises an axial groove extending through the shoulder.

11. The fuel spray device as claimed in claim 10 wherein the groove comprises a V-shaped cross section.

12. The fuel spray device as claimed in claim 9 wherein the second passage comprises a groove defined in the front end of the body, the groove being disposed circumferentially offset from a diametrical line of the bore.

13. The fuel spray device as claimed in claim 9 wherein the cap member comprises a rear end portion extending rearwardly behind the shoulder and being crimped radially and inwardly to secure the body affixed in the cavity of the cap member.

14. The fuel spray device as claimed in claim 9 wherein the cap member is substantially cylindrical and the front end is substantially flat.

15. A liquid spray assembly for a gas turbine engine comprising a body having a cylindrical bore with a closed end and a cap member having a central orifice extending therethrough, the body and cap member in combination defining an chamber positioned within the body generally coaxially with the orifice, the assembly including fluid passages defined between the body and the cap member for swirling introducing of fuel into the bore only at an end of the bore adjacent the cap, thereby causing a spinning fuel flow in the bore to be directed initially, axially away from the cap member and then be redirected by the closed end of the bore centrally out of the chamber through the central orifice.

16. The fuel injector assembly as claimed in claim 15 wherein the passages comprise notches in an end of the body.

17. The fuel injector assembly as claimed in claim 16 wherein the cap member has a substantially flat surface closing an open end of the bore to provide the chamber.

18. The fuel injector assembly as claimed in claim 17 wherein the passages are disposed circumferentially offset from a diametrical line of the bore.

19. The fuel injector assembly as claimed in claim 17 wherein the assembly further comprises a plenum communicating with the passages.

20. The fuel injector assembly as claimed in claim 19 wherein the cap member is crimped to the body.

* * * * *